US007143483B1

(12) United States Patent
Potzman

(10) Patent No.: US 7,143,483 B1
(45) Date of Patent: Dec. 5, 2006

(54) BELT BUCKLE WITH ORNAMENTAL BACKING

(75) Inventor: Dennis Potzman, Billings, MT (US)

(73) Assignee: Montana Silversmiths, Inc., Columbus, MT (US)

( * ) Notice: Subject to any disclaimer, the term of this patent is extended or adjusted under 35 U.S.C. 154(b) by 0 days.

(21) Appl. No.: 11/172,124

(22) Filed: Jun. 30, 2005

(51) Int. Cl.
*A44B 11/20* (2006.01)

(52) U.S. Cl. ..... 24/185; 24/180; 24/163 R; 24/163 K

(58) Field of Classification Search ..... 24/163 K, 24/185, 181, 174, 180, 182, 184
See application file for complete search history.

(56) References Cited

U.S. PATENT DOCUMENTS 3,969,836 A * 7/1976 DuBois ..... 40/665
4,052,773 A * 10/1977 Nesbitt ..... 24/163 K
4,477,949 A * 10/1984 Calabro ..... 24/180
4,570,308 A * 2/1986 Weisgerber ..... 24/163 K
4,753,377 A * 6/1988 Poluhowich ..... 224/163
5,195,220 A 3/1993 Herman ..... 24/163 R
5,294,466 A 3/1994 Baughman ..... 428/14
6,353,977 B1 * 3/2002 Hagmann ..... 24/71 J
2004/0195281 A1 10/2004 Hung ..... 224/163

* cited by examiner

*Primary Examiner*—Robert J. Sandy
*Assistant Examiner*—Marcus Menezes
(74) *Attorney, Agent, or Firm*—Holland & Hart LLP; Kenneth C. Winterton

(57) ABSTRACT

A belt buckle and ornamental backing are provided. The ornamental backing may be removed from the buckle, and a different backing may be placed on the buckle. The ornamental backing may contain ornamentation and/or various color accents for the belt buckle or other articles. A single buckle may be used with multiple different backings, with a backing selected based on the wardrobe of a user, the event, or other factors. The backing may be mounted to the back of the buckle with apertures in the backing corresponding to a prong and a swivel of the buckle. The prong and swivel extend through the apertures allowing the buckle to be secured to a belt with the backing in place.

20 Claims, 17 Drawing Sheets

BELT BUCKLE WITH ORNAMENTAL BACKING

FIELD OF THE INVENTION

The present invention relates generally to fashion accessories, and more particularly, to belts, belt buckles, and ornamental belt buckles.

BACKGROUND OF THE INVENTION

Belts and belt buckles are well known and long time fashion accessories. As is well known, one common use of a belt is to secure clothing about a user's waist with a buckle. Buckles are common devices that secure the two ends of the belt, or strap, together. Generally, the buckle is secured to one end of the belt, and the other end of the belt may be secured to the buckle in a variable manner. Commonly, the other end of the belt has holes along a portion of the belt length that allow a prong of the buckle to secure to the belt at differing lengths. In this manner, the belt may encircle the person's waist and accommodate girth of the waist, which may vary somewhat on a particular day, and between particular people. If a particular person's waist increases or decreases over time by more than the amount that may be accommodated by the second end of the belt, a new belt may be required. The same buckle may be used in certain instances where the buckle is removable from the belt. However, in certain other cases, the buckle and belt are permanently affixed, and thus a new belt and buckle may be required.

Buckles, while widely used for belts and the like, may also be used as decorative ornaments for numerous other articles of clothing, such as, for example, shoes, shirts, and pants, to name but a few. Furthermore, buckles may be integrated directly into the waist of a pair of pants, skirt, or dress, with the articles of clothing having integrated straps which may be adjusted using the buckle.

As mentioned, belts and/or associated buckles may be used as a fashion accessory. In many cases, it is desirable to match a certain belt and/or buckle to a particular clothing ensemble being worn by the person. In these cases, the person often desires to have ornamentation on the belt and/or buckle that may complement the other articles of clothing being worn by the person. Such ornamentation may include, for example, attached decorative articles, gemstones, designs, and different colors associated with the belt and/or buckle.

SUMMARY OF THE INVENTION

The present invention recognizes that it would be desirable to have a single belt buckle which may include multiple different types of ornamentation, including multiple different types of attached decorative articles, gemstones, metal articles, crystals, rhinestones, plastic articles, and/or color accents associated with the buckle. The present invention also recognizes that the cost of manufacturing buckles having such items, such as mounting ornamentation and/or applying color accents, is significantly increased as compared to a buckle having none of these items. Furthermore, even relatively simple buckles can be somewhat expensive, and for a particular user it would be desirable to have relatively few such buckles. Accordingly, the present invention provides a belt buckle and a removable backing which may contain ornamentation and/or various color accents for the belt buckle. In such a manner, the manufacturing cost of the belt buckle is reduced, thus providing a reduced cost belt buckle to an end user relative to a buckle with integrated ornamentation, and also providing a user with the ability to purchase fewer such buckles and still have a relatively wide range of options relative to ornamentation.

In one embodiment, the present invention provides a belt buckle system, comprising (a) a belt buckle comprising a buckle blank having a front side and a back side, a prong operably interconnected with the back side, and a swivel operably interconnected to the back side; and (b) a backing connected to the belt buckle and extending in an axial direction beyond the buckle blank for at least a portion of the periphery of the buckle blank. The backing has first and second apertures, the first aperture sized to fit over the prong and the second aperture sized to fit over the swivel. The prong and swivel extend through the backing when the backing is connected to the belt buckle. The backing may be made of leather, fabric, plastic, or any other material or combination of materials. The backing is operable to the removed from the belt buckle, and a different backing may be mounted to the buckle if desired. The backing may have ornamentation mounted thereon, such as gemstones, metal objects, metal studs, and/or other ornamentation. In one embodiment, the blank has a curvature associated therewith, and the first and second apertures are spaced apart and correspond to a distance between the prong and swivel such that when coupled to the buckle, the backing substantially conforms to the curvature of the blank.

In another embodiment, the present invention provides an ornamental backing for a belt buckle. The ornamental backing comprises a backing sheet having at least a first aperture and adapted to be engaged with at least two projections of a belt buckle. The backing sheet is sized to extend beyond an outer periphery of a belt buckle blank for at least a portion of the outer periphery of the belt buckle blank. The aperture may comprise at least a first and a second aperture spaced such that when connected to the buckle, a prong of the belt buckle extends through the first aperture and a swivel of the belt buckle extends through the second aperture, allowing the buckle to be secured to a belt with the backing affixed thereto.

In yet another embodiment, the present invention provides a belt comprising a belt buckle, a belt strap, and a backing. The belt buckle comprises a blank, a prong interconnected to a first side of the blank, and a swivel interconnected to the first side of the blank and spaced from the prong by a first distance. The belt strap comprises a first end operably engaged with the swivel and a second end adapted to be engaged with the prong. The backing is adapted to be engaged with the swivel and prong, and extends a substantial distance beyond at least a portion of a periphery of the belt buckle when engaged with the swivel and prong. When the backing is engaged with the belt buckle, and the swivel is engaged with the first end, the second end may be passed through the swivel such that the second end is located between the backing and the first end, and the backing is located between the blank and the second end.

These and other aspects of the invention will be readily apparent upon reading the following description of some embodiments of the invention, particularly when taken in conjunction with the drawing figures.

DETAILED DESCRIPTION

Figure 1:
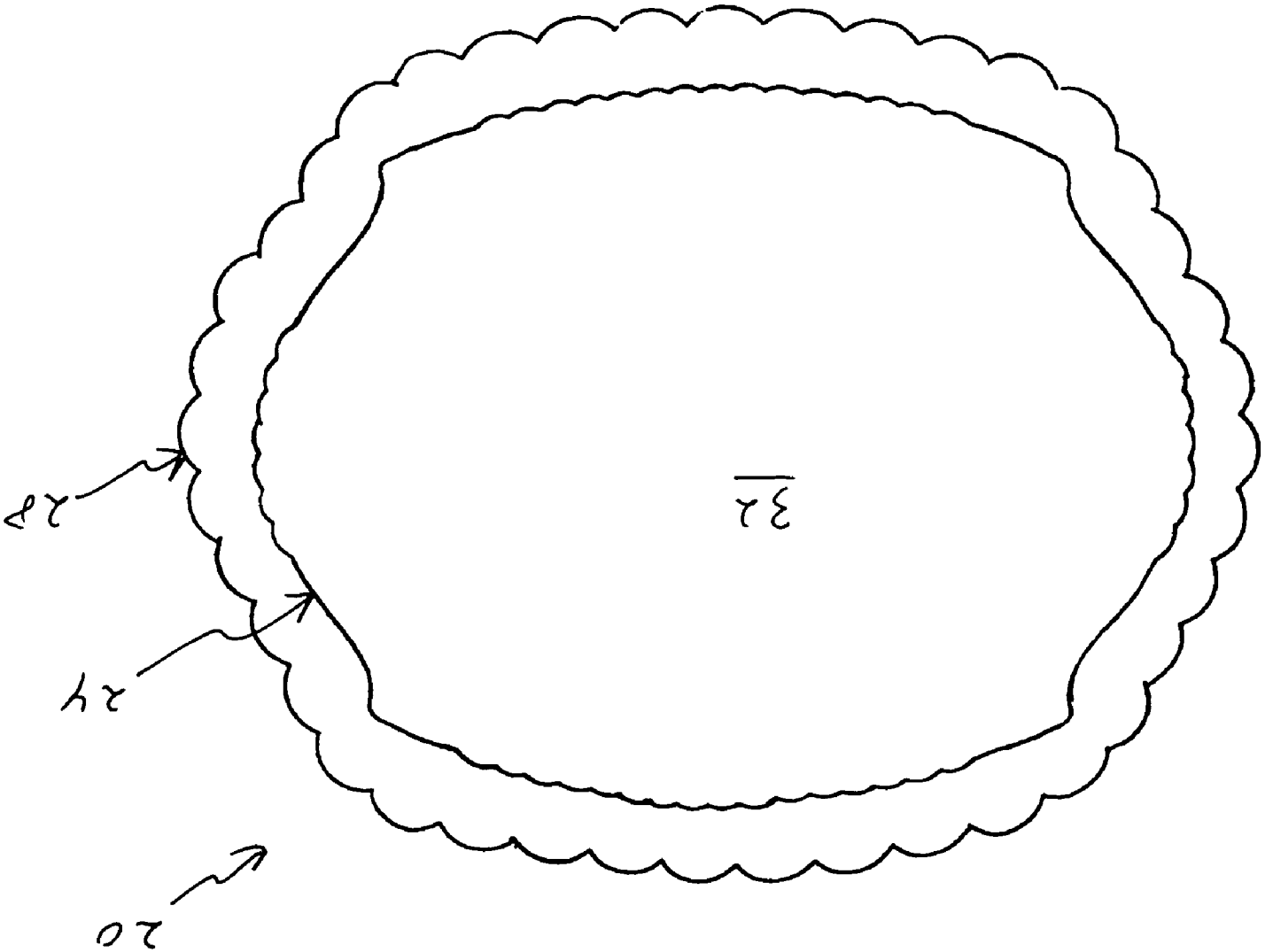
FIG. 1 is a front view of a belt buckle and associated ornamental backing of one embodiment of the invention.

Referring now to FIG. 1, a buckle assembly 20 of an embodiment of the invention is described. The buckle assembly 20 includes a buckle 24 and an ornamental backing 28. As illustrated, the ornamental backing 28 extends beyond the periphery of a blank 32 of the buckle 24. As will be understood, numerous different shapes of belt buckles 24 and/or ornamental backings 28 may be used. For example, belt buckles come in numerous different shapes as will be understood by one of skill in the art, including square, oval, rectangular, and other shapes too numerous to list. The buckle blank 32 is generally the portion of the buckle 24 which is manufactured to incorporate different shapes. Similarly, the backing 28 may be manufactured having a shape that corresponds to the buckle blank 32. The buckle blank 32 may include various different types of ornamentation which are also well known and well understood in the art. For example, such a buckle blank 32 is commonly formed of metal and may include shapes integrated into the metal which depict, for example, horses, automobiles, aircraft, firearms, and/or other objects. Furthermore, the buckle blank 32 may include ridges, elevated portions, and recessed portions that form a decorative design. A buckle blank 32 may also be plated with different materials such as silver and/or gold, to name only two examples, in order to provide further ornamentation. Further, such a buckle blank 32 may also have ornamentation mounted thereto, such as gemstones or any other type of decorative article. Similarly, the backing 28 may also have ornamentation included thereon. Such ornamentation may include, for example, metal articles such as studs or conchos, plastic articles such as plastic stones, rhinestones, crystals, and gemstones mounted around the periphery of the backing 28 such that the gemstones are included on the portion of the backing 28 that extends beyond the periphery of the buckle blank 32. The backing 28 may also be of a ornamental color which provides further ornamentation to the buckle assembly 20.

Figure 2:
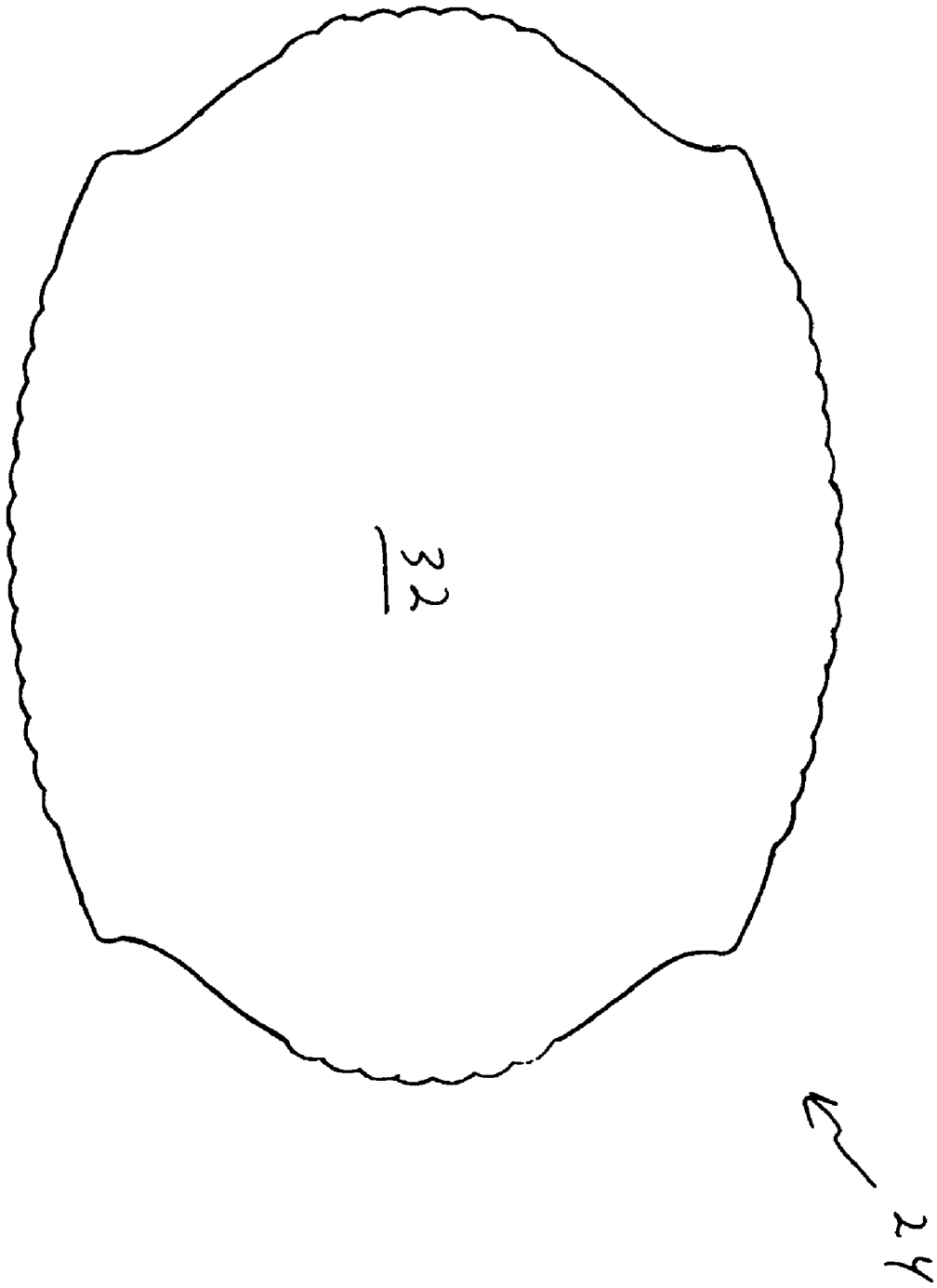
FIG. 2 is a front view of a belt buckle of the embodiment of FIG. 1.
Figure 3:
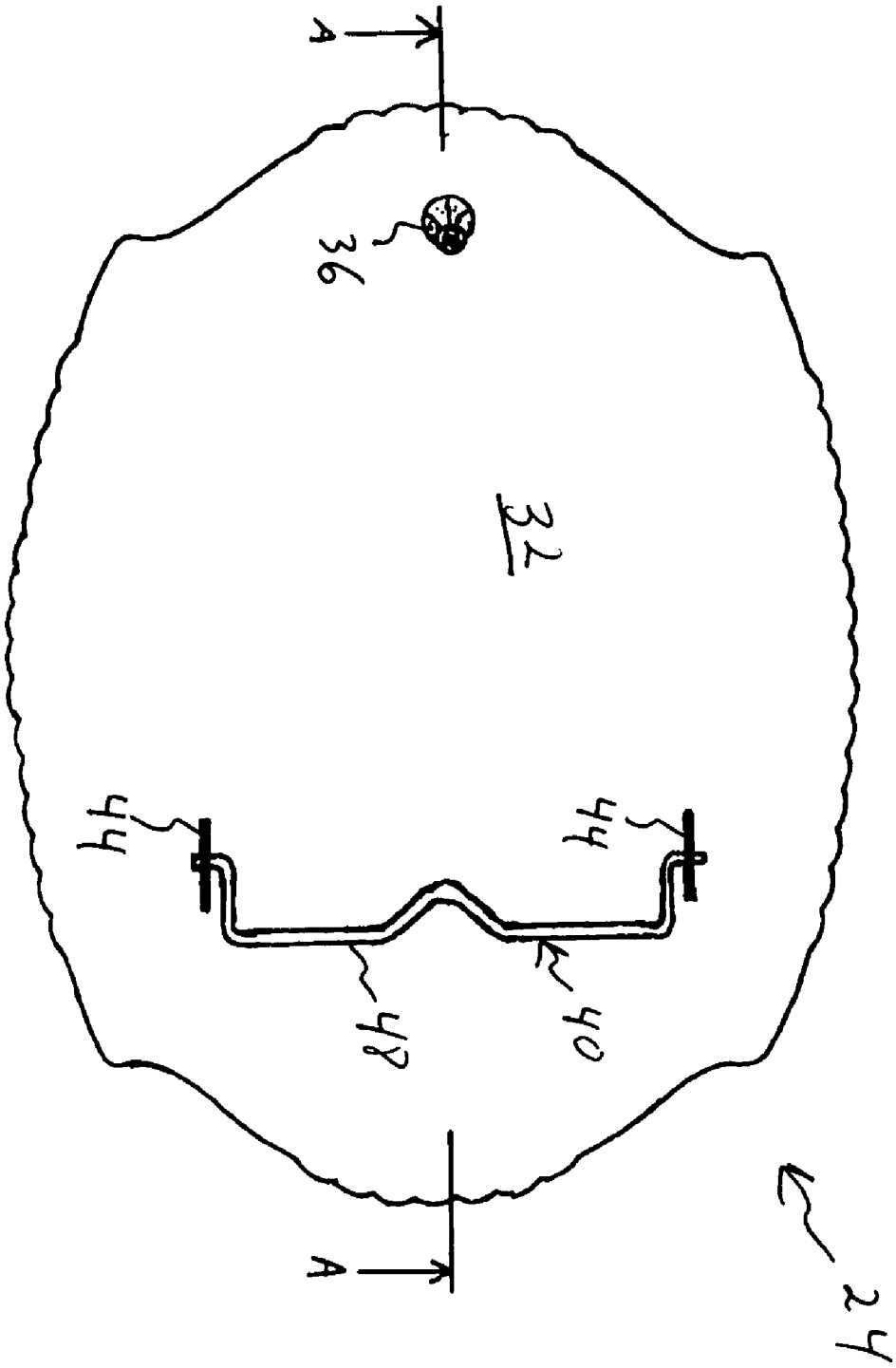
FIG. 3 is a back view of the belt buckle of FIG. 2.

FIGS. 2 and 3 illustrate the front and back sides of the buckle 24 illustrated in the embodiment of FIG. 1. FIG. 2 illustrates the front of the buckle 24 and buckle blank 32, while FIG. 3 illustrates the back side of the buckle. In this embodiment, the buckle is formed of metal, although it will be understood that the buckle 24 may be formed of any appropriate materials, or combinations of materials, such as, for example, plastic, leather, wood, fabric, or composite materials. Referring specifically to FIG. 3, the back side of the buckle 24 includes a prong 36 and a swivel 40 that are used to secure the buckle 24 to a belt and secure the belt at a fixed length around the waist of a user. The swivel 40 includes a pair of anchors 44 that secure a bar 48 to the back of the buckle blank 32. Such a bar 48 commonly is coupled to a buckle end of a belt and used to securely couple the buckle 24 to such a belt. The buckle end of the belt is looped around the bar 48 and secured to hold the bar in a fixed location at the buckle end of the belt. Commonly, buckle ends of belts include fasteners which allow buckles to be removed and replaced as desired by the user. Such belts may have snaps that secure a loop of the belt around the bar 48. Other belts include stitching that secure the end of a belt around the bar 48, and thus the buckle is not easily removable from the belt. The prong 36 typically engages with a hole on the opposite end of the belt and acts to secure the opposite end of the belt from sliding through the buckle 24.

Figure 4:
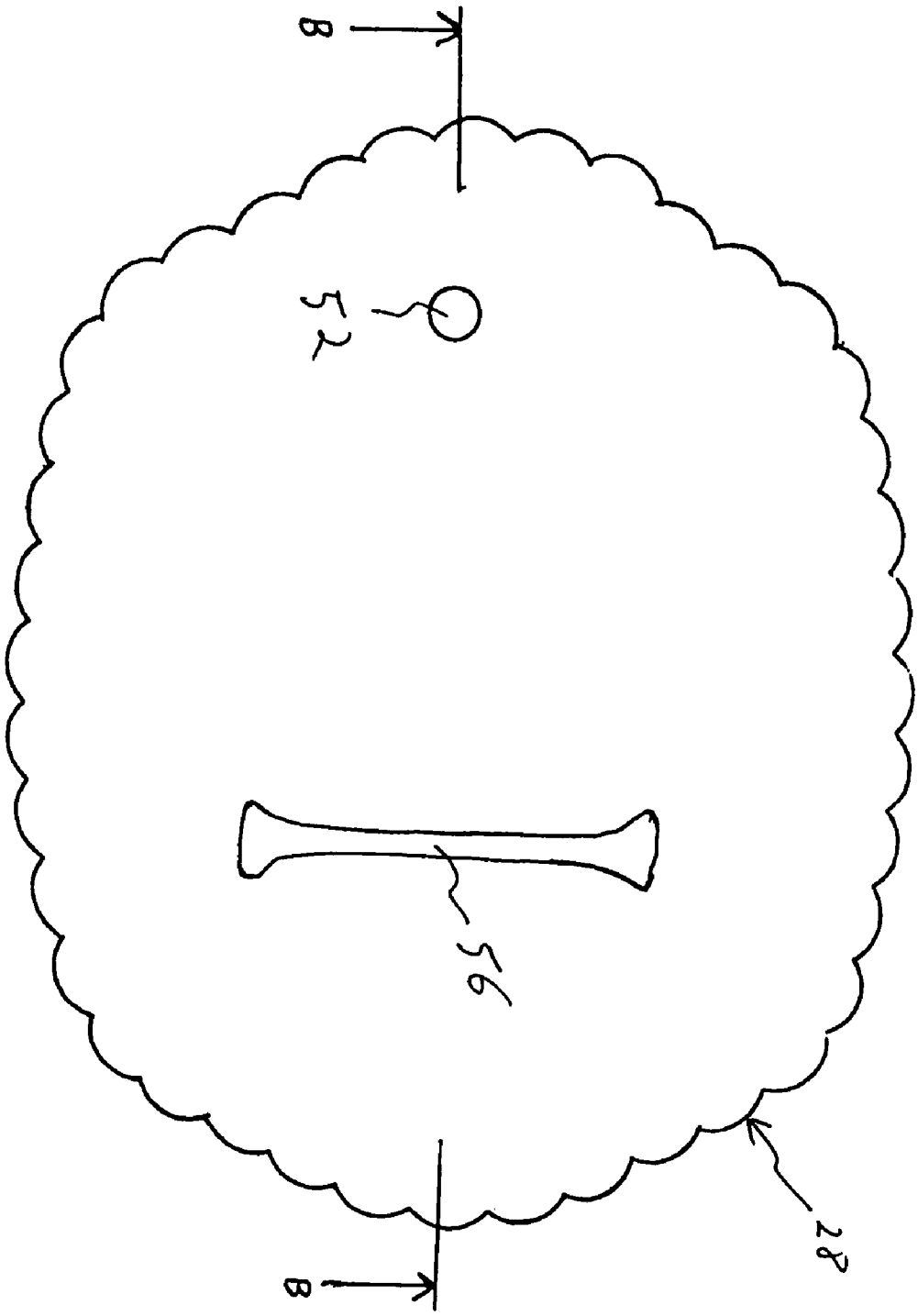
FIG. 4 is a front view of the ornamental backing of FIG. 1.
Figure 5:
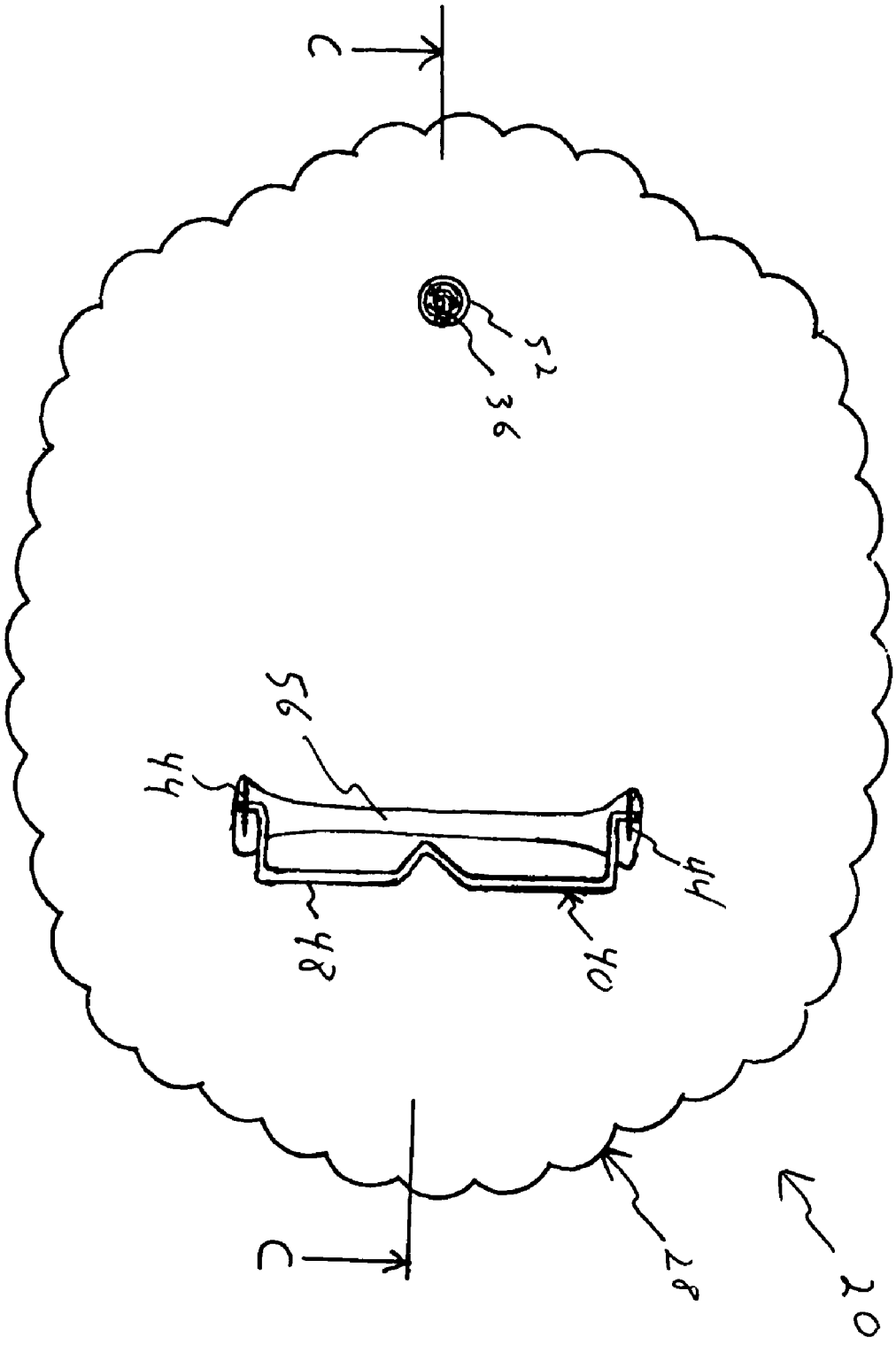
FIG. 5 if a back view of the belt buckle and attached ornamentation backing of FIG. 1.

Referring now to FIG. 4, the backing 28 is illustrated for the embodiment of FIG. 1. In this embodiment, the backing 28 is formed of leather, although it will be understood that the backing 28 may be formed of any suitable material or combinations of material, including, for example, fabric, plastic, and composite materials. In this embodiment, the backing 28 is formed of flexible or malleable material that may be affixed with relative ease to the back of the buckle 24, as will be described in more detail below. However, it is contemplated that the backing 28 in other embodiments may be formed of relatively rigid material, and affixed to the buckle in a manner that would be readily apparent to one of skill in the art. As illustrated in FIG. 4, the backing 28 includes two apertures, namely a first aperture 52 and a second aperture 56. The first aperture 52 is sized and positioned such that it may cooperate with the prong 36 of the buckle 24 (FIG. 3). Similarly, the second aperture 56 is sized and positioned to cooperate with the swivel 40 of the belt buckle 24 (FIG. 3). FIG. 5 illustrates the backing 28 and buckle 24 with the backing mounted thereto. As can be observed from the illustration, the first aperture 52 fits over the prong 36, and the second aperture 56 fits over the swivel 40. In this manner, the backing is securely affixed to the back side of the buckle 24, thereby providing additional ornamentation to the front side of the buckle assembly 20. The backing 28 may be sized, and the first and second apertures 52, 56 may be spaced from one another such that when engaged with the prong 36 and swivel 40, respectively, pressure is applied by the backing 28 to the interior portions of the prong 36 and swivel 40 relative to one another. This pressure helps secure the backing 28 to the buckle 24.

Figure 6:
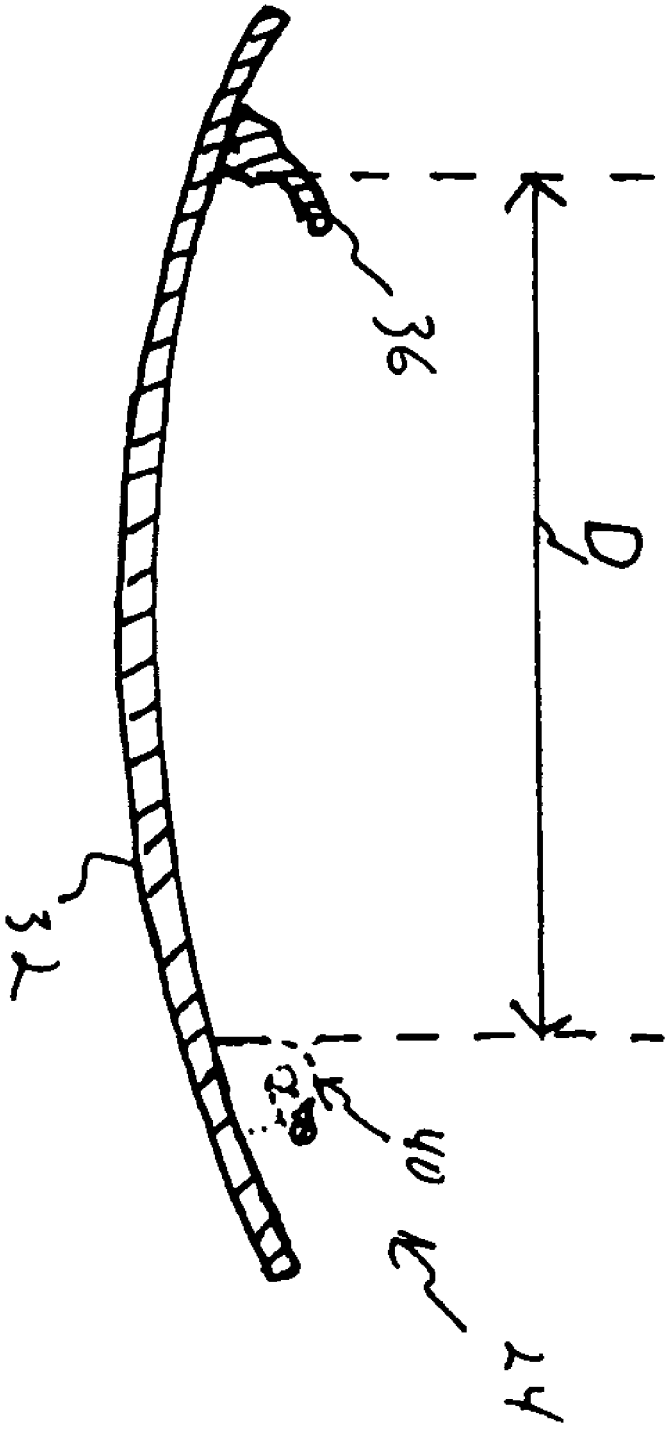
FIG. 6 is a cross section view along section A—A of FIG. 3.
Figure 7:
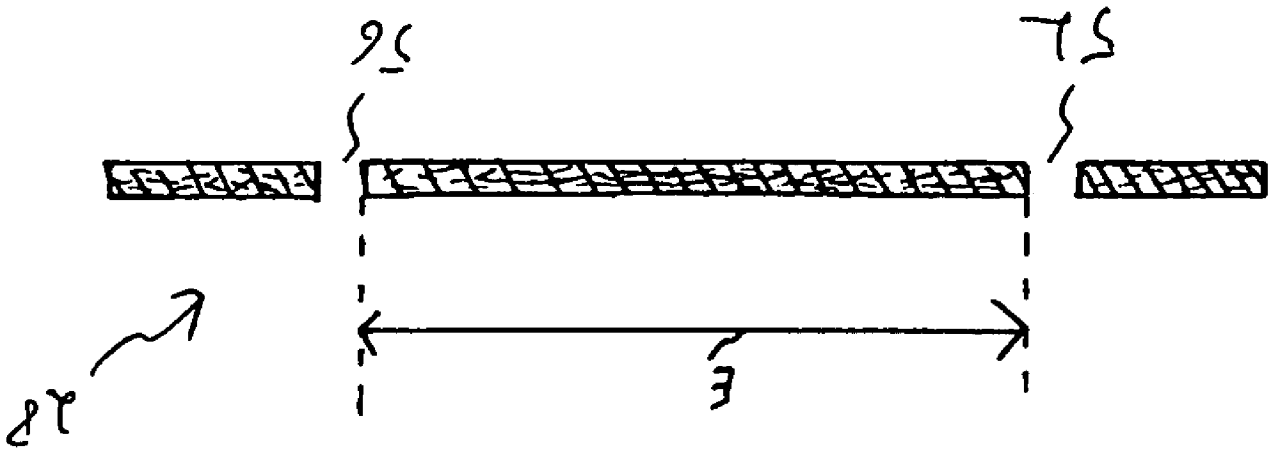
FIG. 7 is a cross sectional view along section B—B of FIG. 4.
Figure 8:
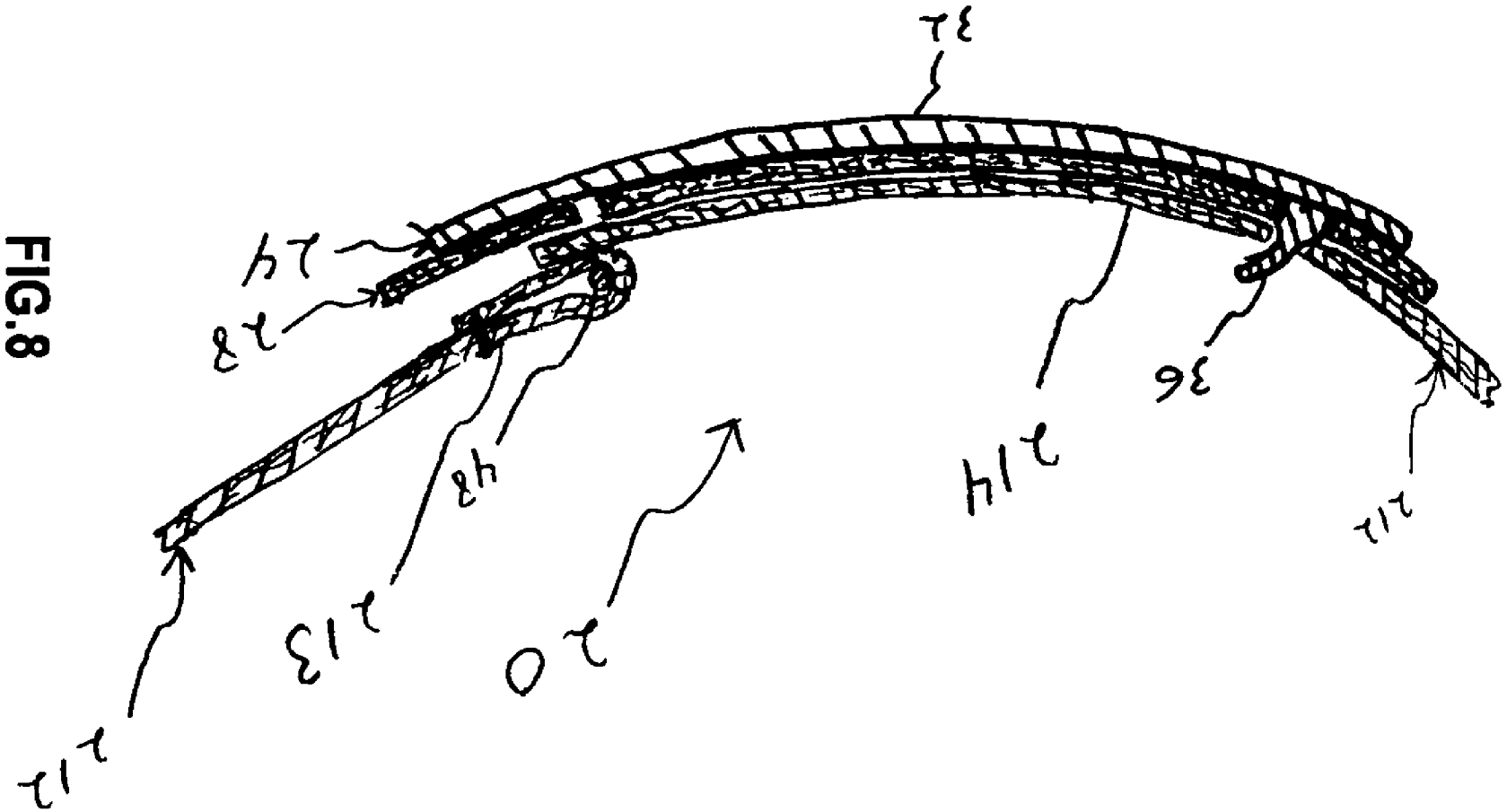
FIG. 8 is a cross sectional view along section C—C of FIG. 5.

Referring to FIGS. 6–8, cross-sectional illustrations of the buckle 24, backing 28, and assembled buckle assembly 20 are illustrated. FIG. 6 illustrates a cross-section of the buckle taken along section A—A (FIG. 3). As illustrated, the buckle blank 32 and associated prong 36 and swivel 40 are formed of metal with the prong 36 and swivel 40 separated by a distance D. The distance D is measured, in this illustration, as the distance between the inside edge of the prong 36 and the inside edge of the swivel anchors 44. Referring to FIG. 7, a cross-sectional illustration of the backing 28 taken along section B—B (FIG. 4) is illustrated. The backing 28 in this embodiment is formed of a single piece of leather having the apertures cut or stamped out of the piece of leather. The inside edge of the first aperture 52 and the inside edge of the second edge 56 are separated by a distance noted as E in FIG. 7. In one embodiment, the distance E is somewhat larger than the distance D, resulting in the backing 28 conforming to a curve in the buckle blank 32. In one embodiment, the distance E is selected to correspond to the distance associated with the arc of the buckle blank 32 between the prong 36 and swivel 40. As illustrated in FIG. 8, a cross-section of the buckle assembly 20, taken along section C—C (FIG. 5) is illustrated along with an exemplary belt 212 attached thereto. A buckle end 213 of the belt is secured to the bar 48 of the swivel as described above, with the opposite end 214 of the belt engaged with the prong 36. As may be observed from the illustration, the backing conforms to the curvature of the buckle blank 32 of the buckle 24. This curvature is referred to as the dap of the buckle 24. The dap results in a curved buckle that emulates the curvature of a person's body and enhances comfort while also providing a buckle 24 which is less likely to protrude inconveniently at its edges. As described in this embodiment, the distance E is somewhat greater than the distance D, resulting in pressure being applied by the inside edge of the first aperture 52 to the inside edge of prong 36 and the inside edge of second aperture 56 against the inside edges of anchors 44 of the swivel 40. This pressure results in the backing 28 conforming substantially to the curvature of the buckle blank 32. In this manner, the backing 28 is more securely coupled to the buckle 24. As illustrated in FIG. 8, the backing 28 extends beyond a periphery of the buckle blank 32.

Figure 9:
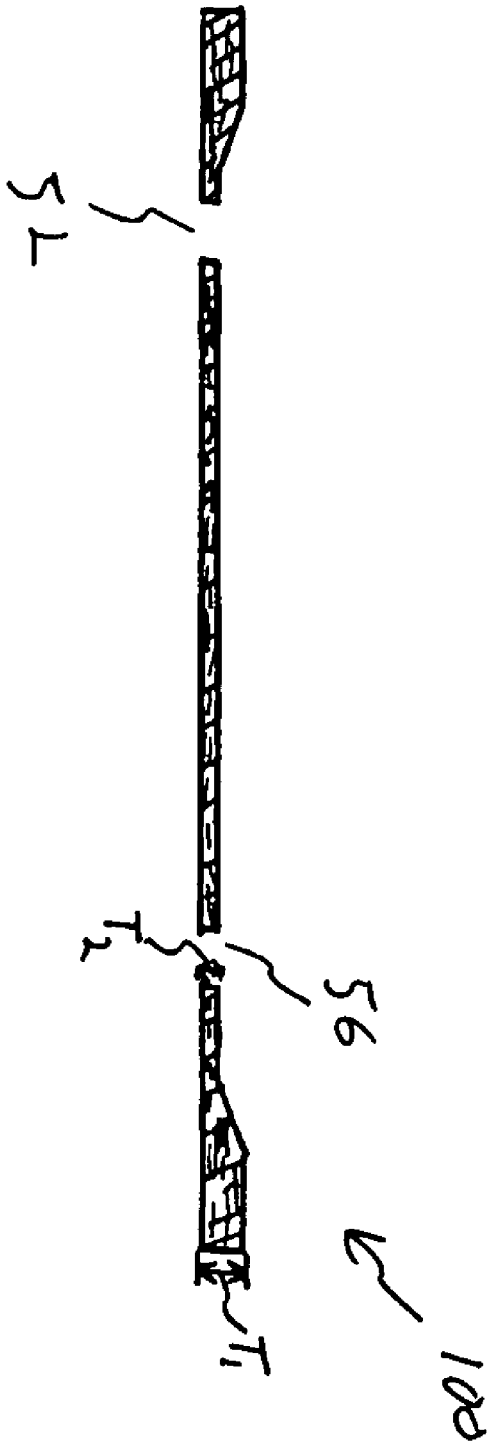
FIG. 9 is a cross sectional view along section B—B of FIG. 4 for another embodiment of the present invention.
Figure 10:
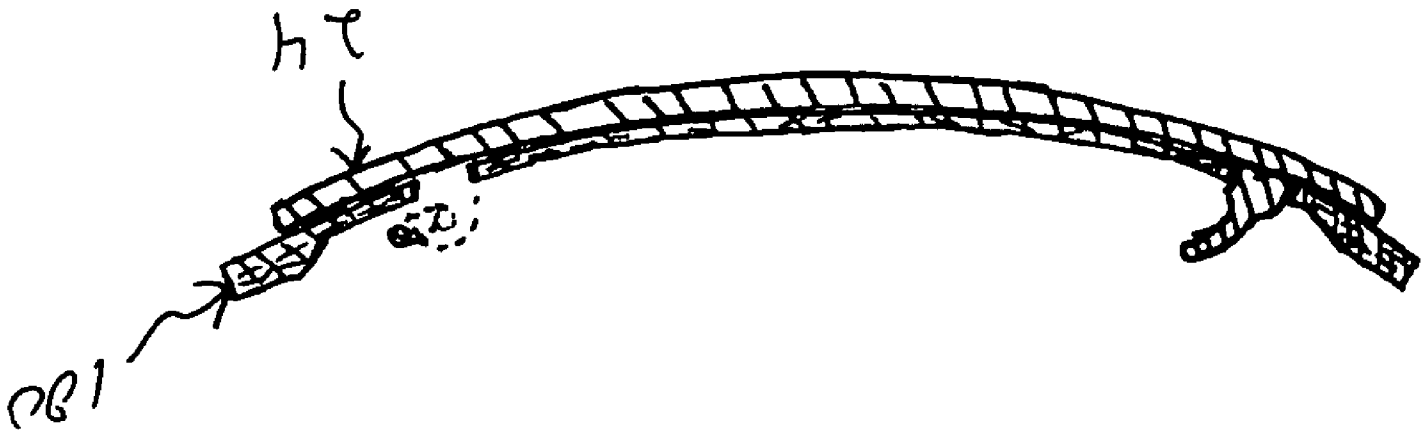
FIG. 10 is a cross sectional view along section C—C of FIG. 5 for the embodiment of FIG. 9.

The backing 28 is illustrated in FIGS. 1–6 as extending beyond the periphery of the buckle blank 32 throughout the entire periphery of the buckle blank 32. However, the backing 28 may extend beyond the buckle blank periphery for only a portion of the buckle blank, such as only the top, bottom, left, or right sides, or any combination thereof. Furthermore, while the backing 28 is illustrated in FIGS. 7 and 8 as having a uniform thickness, the backing may also have non-uniform thickness throughout the body thereof. As illustrated in FIG. 9, a backing 100 of another embodiment of the invention is illustrated. The backing 100 includes first and second apertures 52, 56 as described with respect to the previous figures. The thickness of the backing 100 is reduced over a central portion of the backing 100. Illustrated in FIG. 9, the edges, or periphery, of the backing 100 have a first thickness $T_1$, while the central portion of the backing 100 has a second, thinner thickness $T_2$. This difference in thicknesses allows the backing 100 to more easily conform to the curvature of the buckle blank 32, as illustrated in FIG. 10. Furthermore, such a reduced thickness $T_2$ around the swivel 40 portion of the buckle 24 provides for additional space between the bar 48 and the backing 100, thereby allowing a user to more easily thread the opposing end of the belt through the swivel when wearing the buckle assembly.

Figure 11:
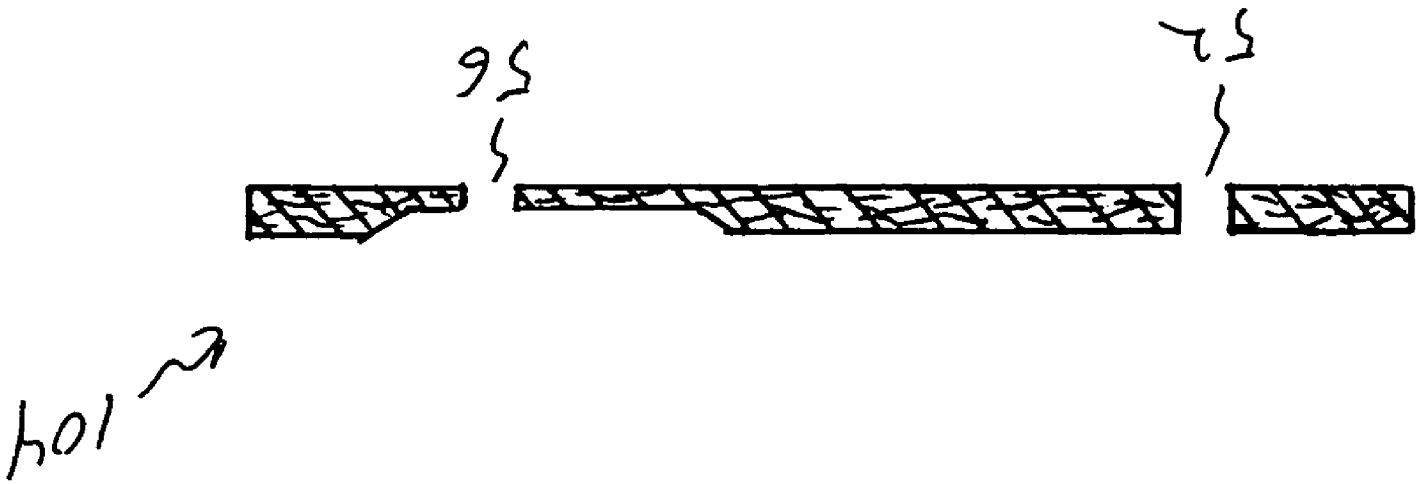
FIG. 11 is a cross sectional illustration along section B—B of FIG. 4 for another embodiment of the invention.
Figure 12:
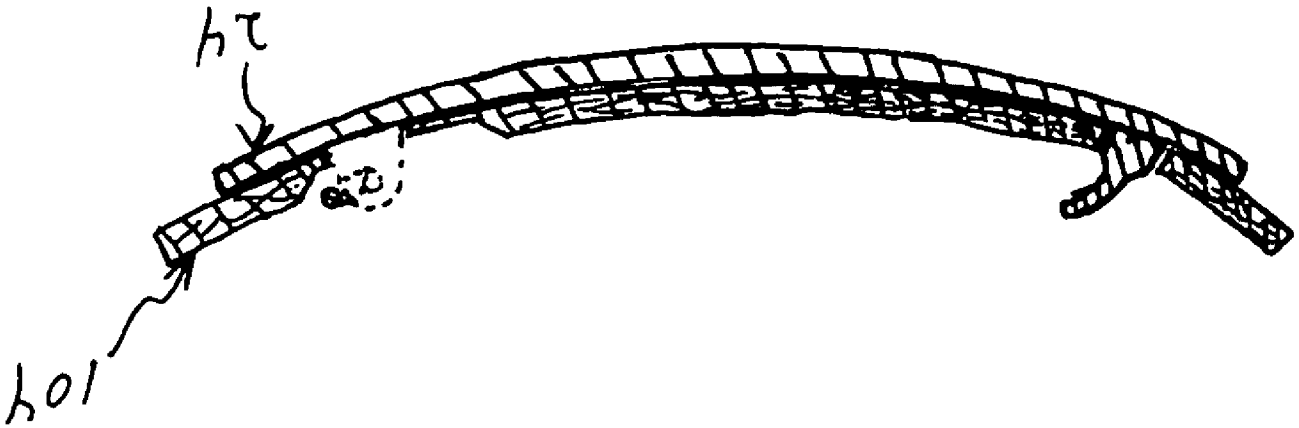
FIG. 12 is a cross sectional illustration along section C—C of FIG. 5 for the embodiment of FIG. 11.

Referring to FIGS. 11 and 12, yet another embodiment of a backing having differing thicknesses is illustrated. In this embodiment, the backing 104 has a reduced thickness in proximity to the second aperture 56. This reduced thickness allows for relative ease in threading a belt end through the swivel 40 when a user is wearing the buckle, and also provides similar increases in flexibility of the backing as described with respect to FIGS. 9 and 10.

Figure 13:
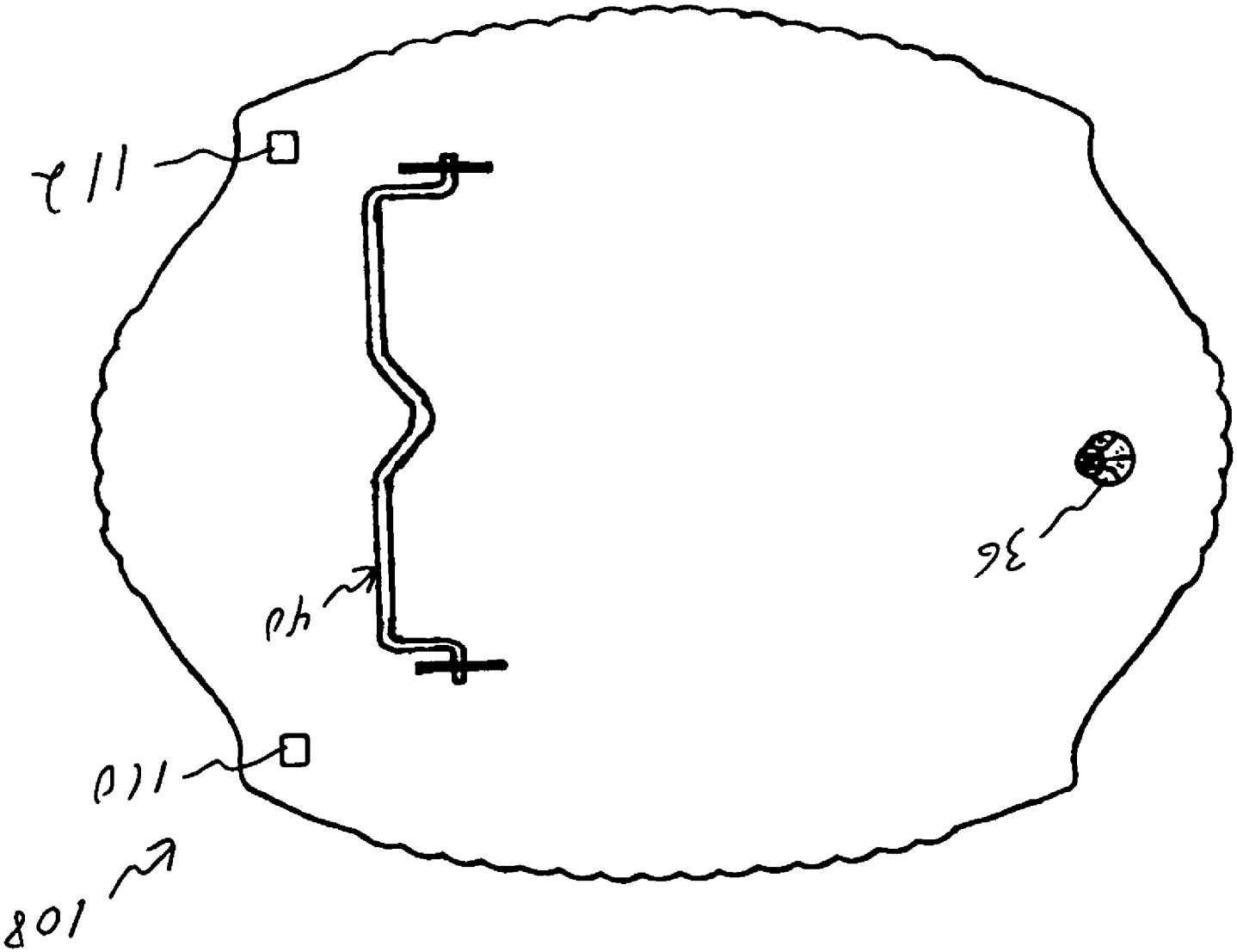
FIG. 13 is a back view of a belt buckle of another embodiment of the invention.
Figure 14:
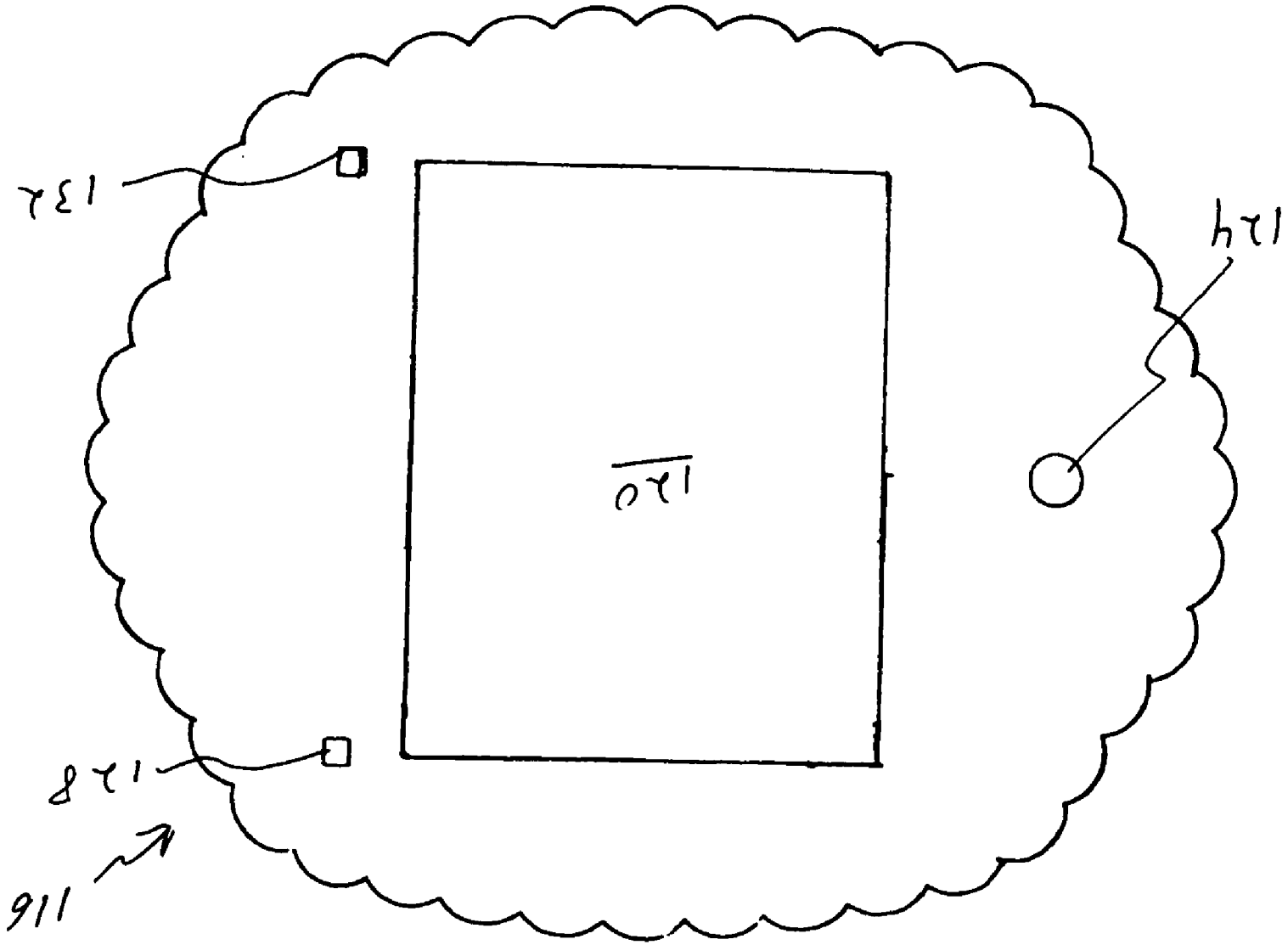
FIG. 14 is a front view of an ornamental backing for another embodiment of the invention.
Figure 15:
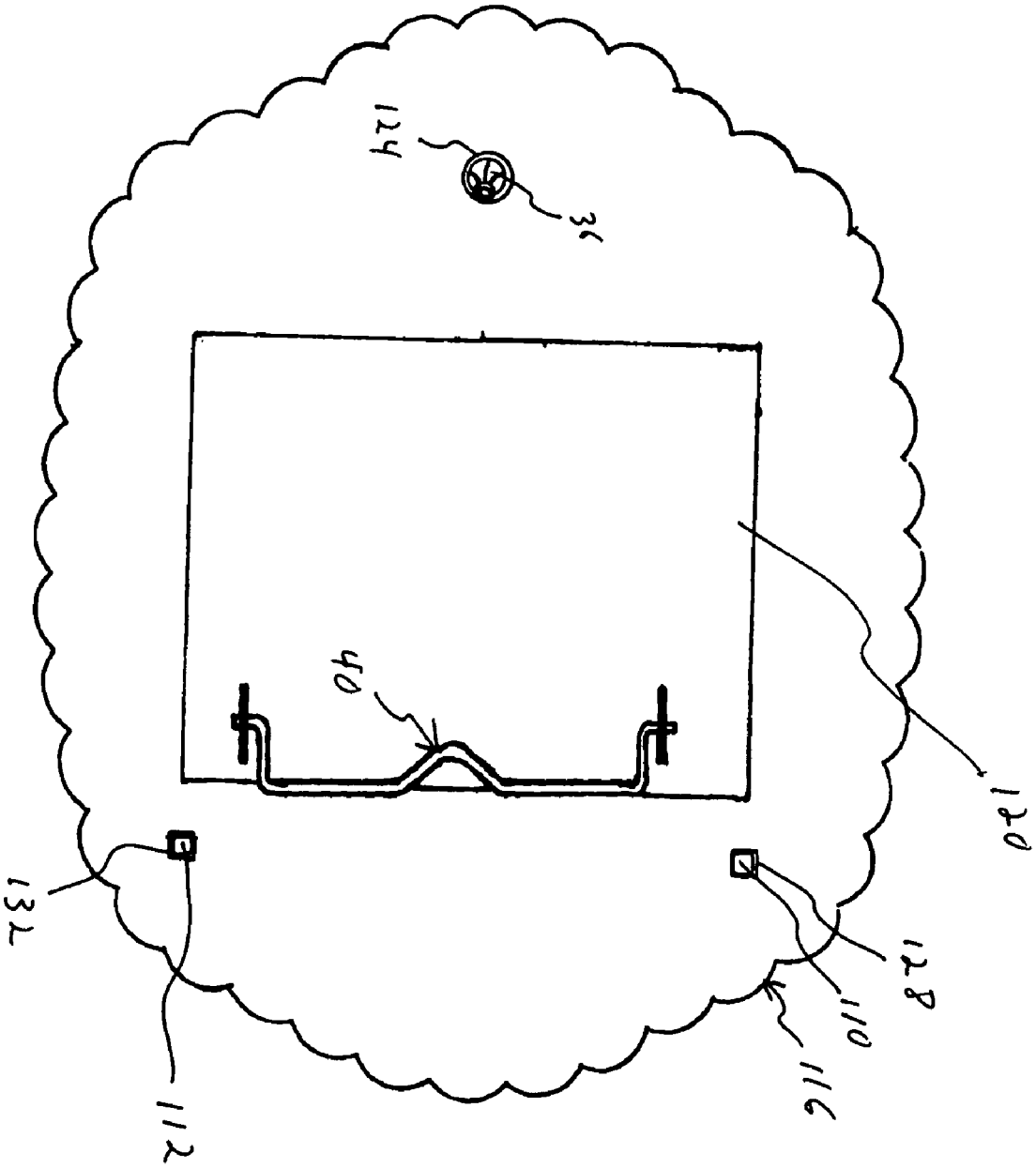
FIG. 15 is a back view of the buckle of FIG. 13 and the backing of FIG. 14.

Referring now to FIGS. 13–15, a buckle 108 and backing 116 of another embodiment of the invention are illustrated. In this embodiment, the buckle 108 includes a first projection 110 and a second projection 112 in addition to the prong 36 and swivel 40 assemblies. These additional projections 110, 112 provide the connection point between the backing 116 and the buckle 108, along with prong 36. Illustrated in FIG. 14 is a backing 116 for this embodiment. The backing 116 in this embodiment includes four apertures, first aperture 120 is a relatively large rectangular aperture which the swivel 40 may fit through, as illustrated in FIG. 15. The second aperture 124 corresponds to the location of the prong 36 of buckle 108, while the third and fourth apertures 128, 132 correspond to the first and second projections 110, 112, respectively of buckle 108. Similarly as previously described, the distances between the first aperture and third and fourth apertures may be selected such that the backing 116 conforms to the curvature of the blank of buckle 108. Such an embodiment may allow for easier removal of the backing 116 while the buckle 108 is attached to a belt. For example, the belt may be threaded through the first aperture 120 when the backing is being coupled to the buckle 108. Such a backing 116 may be particularly useful in embodiments where the buckle 108 is not removable from the belt. Additionally, various other backing and buckle combinations may be used, such as, for example, a backing having a single large central aperture that is secured to the buckle with fastening devices such as snaps.

Figure 16:
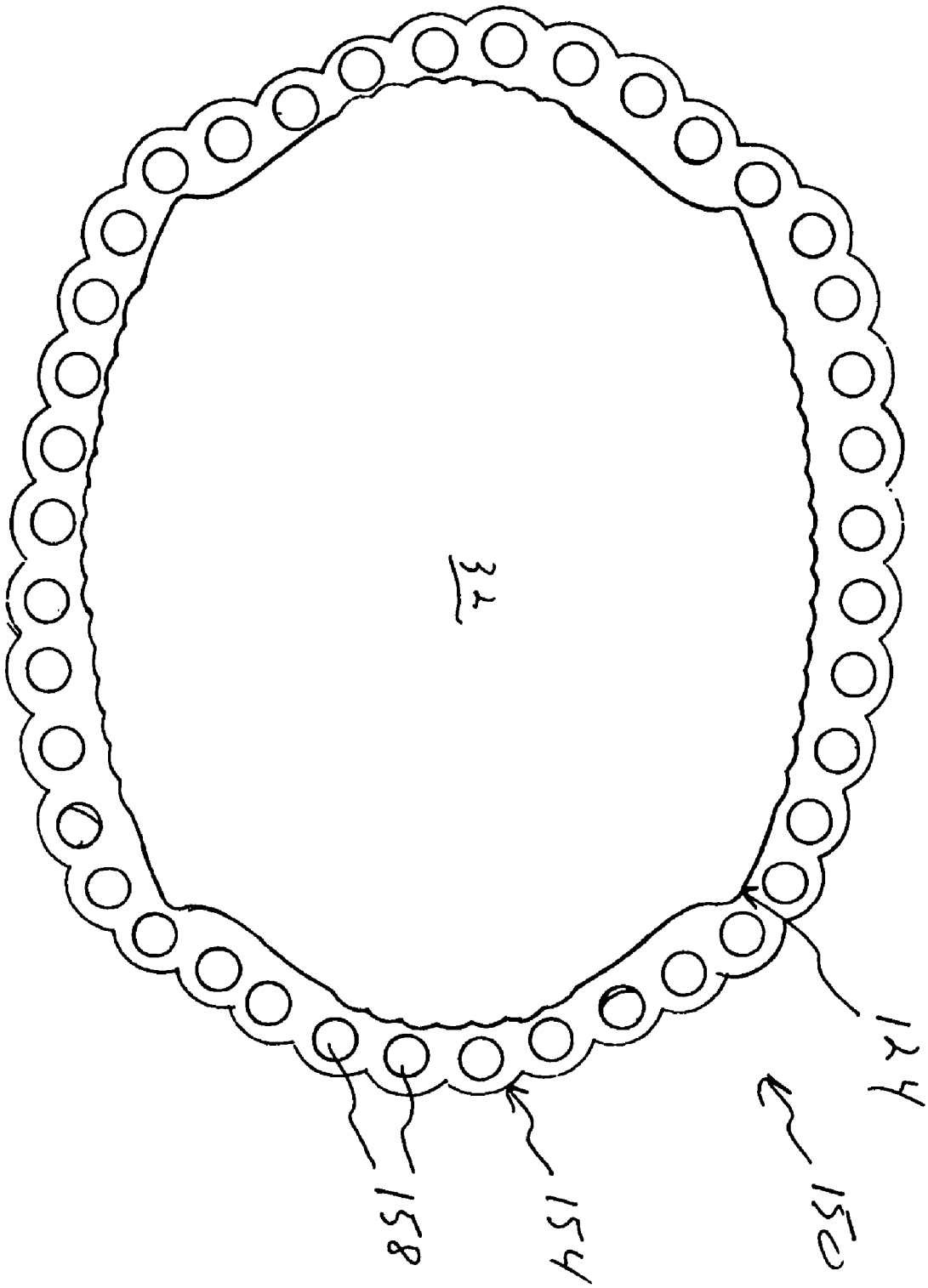
FIG. 16 is a front view of a buckle and decorative backing where the backing contains gemstones.

Referring now to FIG. 16, a buckle assembly 150 of another embodiment of the invention is described. In this embodiment, the buckle 124 and backing 154 are coupled such that ornamentation 158 mounted on the backing is visible around the entire periphery of the blank 32 of buckle 124. Such ornamentation may include, for example, gemstones, metal studs, or other ornamental type features similarly as discussed above. For example, in one embodiment, the ornamentation 158 includes rhinestones. It will be understood that numerous options exist for such ornamentation, and in one embodiment the ornamentation includes one or more diamonds or other gemstones. Furthermore, in a manner as described previously, numerous different backings 154 may be purchased for use with a single buckle 124. For example, a user may have a backing 154 that is adorned with ornamentation such as gemstones, and the user may only want to wear such an ornamental backing on certain special occasions. The backing may be removed and optionally replaced with another backing with different, and/or less valuable ornamentation. Similarly, backings may have different colors and/or different colored ornamentation along with a particular backing selected based upon the outfit that the user is wearing on a particular occasion. Likewise, the backing may simply be removed and the buckle worn without the backing.

Figure 17:
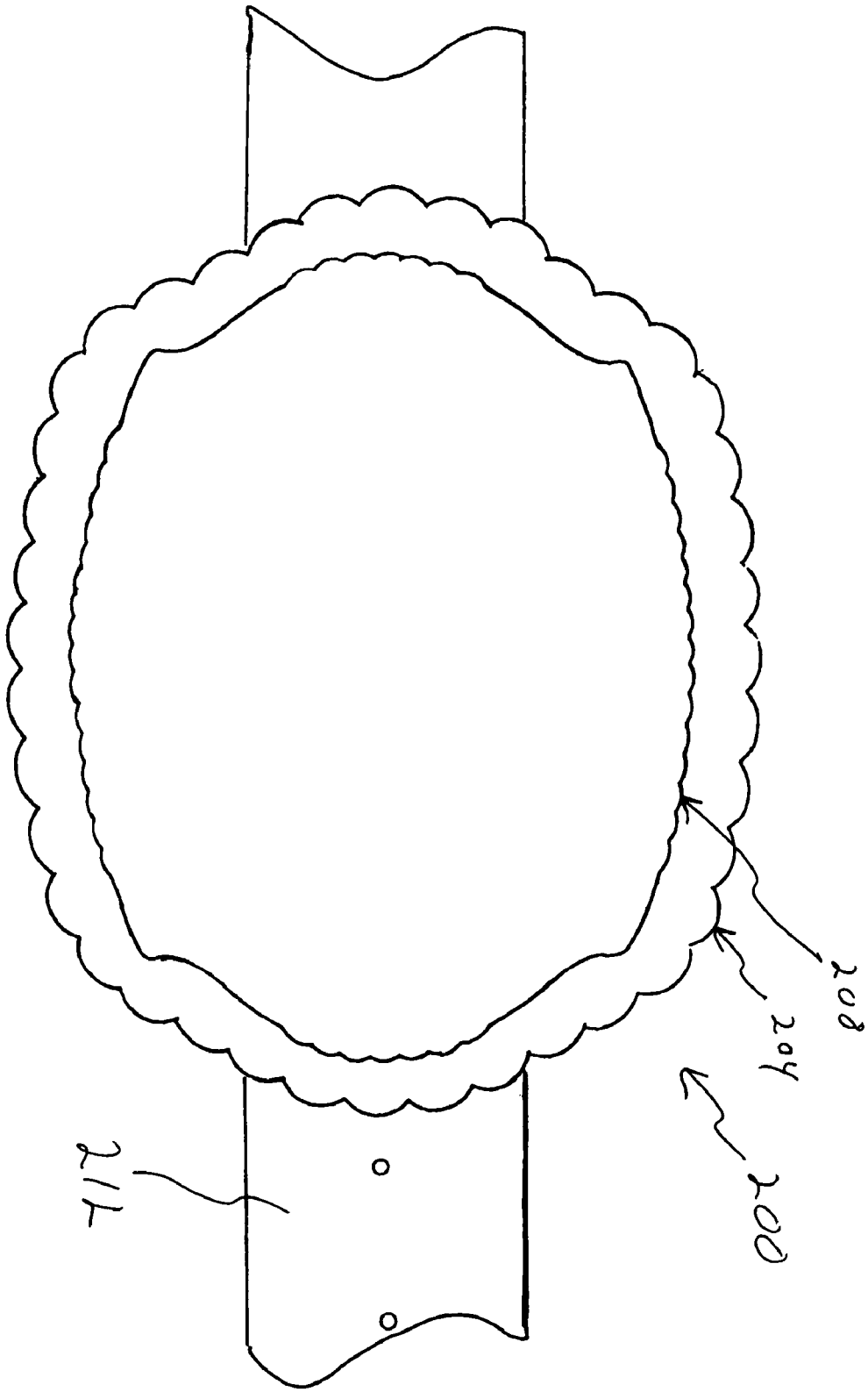
FIG. 17 is a front view of a buckle, backing, and associated belt for an embodiment of the invention.

Referring now to FIG. 17, a belt assembly 200 is illustrated for an embodiment of the invention. As described, the belt 212 is coupled with the buckle 208, with backing 204 visible in front of the belt 212 and behind the buckle 208. As described briefly above, belts commonly are manufactured to allow for the belt to be affixed to different buckles. In one embodiment, a belt 212 and matching backing 204 are sold together, with ornamentation and/or color on the backing 204 matching ornamentation and/or color of the belt 212.

As described, such a buckle and backing assembly may be useful in numerous situations. For example, different backings may be purchased to match a particular shirt and/or pants of a user. In such a case, a retail establishment may sell both a shirt and a matching backing, or pants and matching backing. Furthermore, in one embodiment, the backings are sold without any pre-cut apertures, and have directions instructing a user to cut appropriate apertures based upon an existing buckle the user may wear. In such a case, when a backing alone is purchased, the buckle that a user may have in mind to use with the backing may have a prong and swivel that are spaced at differing distances compared to other buckles, and thus a custom cutting of apertures is required in order for the backing to properly couple with such a buckle. The instructions provided with the backing inform the user how to cut or stamp the apertures at the appropriate locations. Similarly, an establishment may provide a service to cut or stamp the apertures into the backing.

Furthermore, it is contemplated that other articles may also be sold with particular backings that complement the article. For example, a saddle may include unique ornamentation thereon and be sold with a buckle and/or backing that has similar or matching type ornamentation. Likewise, it is common for ornamentation to be sold separately from a saddle or other tack, such as a bridle, with the ornamentation being affixed to the tack by a user. In such cases, the ornamentation may have an associated backing that has matching or complementary colors, design, or ornamentation. Similarly, if a hat or other article that a user is wearing on a specific occasion has a unique design element thereon, a backing with similar unique type design elements may be included.

While the invention has been particularly shown and described with reference to various embodiments thereof, it will be readily understood by those skilled in the art that various other changes in the form and details may be made without departing from the spirit and scope of the invention.

What is claimed is:

1. A belt buckle system, comprising:

a belt buckle comprising a buckle blank having a front side and a back side, a prong operably interconnected to said back side, and a swivel operably interconnected to said back side, wherein said swivel engages with a belt strap to secure the belt strap to said blank; and a backing connected to said belt buckle and extending in an axial direction beyond said buckle blank for at least a portion of the periphery of said buckle blank, said backing having first and second apertures, said first aperture sized to fit over said prong and said second aperture sized to fit over said swivel, wherein said prong and swivel extend through said backing when said backing is connected to said belt buckle.

2. The belt buckle system of claim 1, wherein said backing is made of leather.

3. The belt buckle system of claim 1, wherein said backing is operable to be removed from said belt buckle.

4. The belt buckle system of claim 1, wherein said backing comprises ornamentation mounted thereon.

5. The buckle system of claim 4, wherein said ornamentation comprises at least one of metal articles, plastic articles, rhinestones, crystals, and gemstones.

6. The belt buckle system of claim 4, wherein said ornamentation is reflective.

7. The belt buckle system of claim 1, wherein said backing has a first thickness around a periphery thereof and a second thickness in proximity to at least said second aperture, wherein said second thickness is less than said first thickness.

8. The belt buckle system of claim 1, wherein said blank has a curvature associated therewith, and said first and second apertures are spaced apart and correspond to a distance between said prong and said swivel such that when coupled to the buckle, said backing substantially conforms to said curvature of said blank.

9. An ornamental backing for a belt buckle comprising:

a backing sheet having at least a first and a second aperture spaced such that when connected to a belt buckle, a prong of the belt buckle extends through said first aperture and a swivel of the belt buckle extends through said second aperture, wherein the backing substantially conforms to a curvature of a blank of the belt buckle, and wherein said backing sheet is sized to extend beyond an outer periphery of a belt buckle blank for at least a portion of the outer periphery of the belt buckle blank, wherein the belt buckle interconnects with a belt strap to secure the belt strap to the belt buckle in a fixed location relative to the belt buckle independently of said backing sheet.

10. The ornamental backing for a belt buckle, as claimed in claim 9, wherein said backing is formed of leather.

11. The ornamental backing for a belt buckle, as claimed in claim 9, wherein said backing includes ornamentation attached thereto.

12. The ornamental backing for a belt buckle, as claimed in claim 11, wherein said ornamentation is reflective.

13. The ornamental backing for a belt buckle, as claimed in claim 11, wherein said ornamentation comprises at least one of metal articles, plastic articles, rhinestones, crystals, and gemstones.

14. A belt, comprising:

a belt buckle, comprising:

a blank;

a prong interconnected to a first side of said blank; and a swivel interconnected to said first side of said blank and spaced apart from said prong;

a belt strap, comprising:

a first end interconnected with said swivel; and a second end adapted to be engaged with said prong; and a backing adapted to be interconnected with said swivel and prong and extending a substantial distance beyond at least a portion of a periphery of said belt buckle, wherein said swivel and prong extend through one or more apertures in said backing, and wherein said backing may be disconnected from said swivel and prong and removed from said belt buckle;

wherein, when said backing is interconnected with said belt buckle, said second end may be engaged with said prong such that said backing is located between said blank and said second end, and wherein said second end is engaged with said prong to secure said second end to said buckle.

15. The belt, as claimed in claim 14, further comprising:

at least a second backing adapted to be engaged with said belt buckle, and wherein the backing may be removed from said belt buckle and said second backing engaged thereto.

16. The belt, as claimed in claim 15, wherein said first and second backings are different colors.

17. The belt, as claimed in claim 14, wherein said backing comprises ornamentation.

18. The belt, as claimed in claim 14, wherein said ornamentation is similar to ornamentation on said belt strap.

19. The belt, as claimed in claim 17, wherein said ornamentation comprises at least one of metal articles, plastic articles, rhinestones, crystals, and gemstones.

20. The ornamental backing for a belt buckle, as claimed in claim 9, wherein said backing sheet is flexible.

* * * * *

UNITED STATES PATENT AND TRADEMARK OFFICE

CERTIFICATE OF CORRECTION

PATENT NO. : 7,143,483 B1
APPLICATION NO. : 11/172124
DATED : December 5, 2006
INVENTOR(S) : Potzman It is certified that error appears in the above-identified patent and that said Letters Patent is hereby corrected as shown below:

Column 9, claim 18, line 5, delete “claim 14”, and insert --claim 17--.

Signed and Sealed this

Sixth Day of March, 2007

JON W. DUDAS
*Director of the United States Patent and Trademark Office*